US005703035A

United States Patent [19]

Birkhan et al.

[11] Patent Number: 5,703,035

[45] Date of Patent: Dec. 30, 1997

[54] HIGHLY CONCENTRATED AQUEOUS FABRIC SOFTNERS HAVING IMPROVED STORAGE STABILITY

[75] Inventors: Horst Birkhan, Steinau-Ulmbach; Michael Fender; Bernhard Irrgang, both of Bad Soden-Salmünster; Christiane Löffert, Schlüchtern; Simone Schüssler, Bad Orb, all of Germany

[73] Assignee: Witco Surfactants GmbH, Steinau an der Strasse, Germany

[21] Appl. No.: 730,959

[22] Filed: Oct. 16, 1996

Related U.S. Application Data

[63] Continuation of Ser. No. 391,789, Feb. 21, 1995, abandoned.

[30] Foreign Application Priority Data

Feb. 23, 1994 [DE] Germany ..... P 44 05 702.4

[51] Int. Cl.[6] ..... C11D 3/30; C11D 3/32

[52] U.S. Cl. ..... 510/423; 510/433; 510/501; 510/504; 510/522; 510/527

[58] Field of Search ..... 510/423, 433, 510/501, 504, 506, 522, 527

[56] References Cited

U.S. PATENT DOCUMENTS

| | | | |
|---|---|---|---|
| 2,017,051 | 10/1935 | Ransom et al. | 260/127 |
| 2,078,922 | 5/1937 | Arnold et al. | 260/127 |
| 3,349,033 | 10/1967 | Zuccarelli et al. | 252/8.75 |
| 3,644,203 | 2/1972 | Lamberti et al. | 252/8.75 |
| 3,915,867 | 10/1975 | Kang et al. | 252/8.8 |
| 3,997,453 | 12/1976 | Wixon | 252/8.75 |
| 4,073,735 | 2/1978 | Ramachandran | 252/8.8 |
| 4,119,545 | 10/1978 | Chazard et al. | 252/8.8 |
| 4,137,180 | 1/1979 | Naik et al. | 252/8.8 |
| 4,830,771 | 5/1989 | Ruback et al. | 252/8.8 |
| 4,844,823 | 7/1989 | Jacques et al. | 252/8.8 |
| 5,093,014 | 3/1992 | Nellie | 252/8.8 |
| 5,108,508 | 4/1992 | Birkhan et al. | 252/8.8 |
| 5,133,885 | 7/1992 | Condor et al. | 252/8.6 |
| 5,154,838 | 10/1992 | Yamamura et al. | 252/8.6 |
| 5,254,270 | 10/1993 | Birkhan et al. | 252/8.8 |
| 5,254,271 | 10/1993 | Hamann et al. | 252/8.8 |
| 5,364,542 | 11/1994 | Birkhan et al. | 252/8.8 |
| 5,368,755 | 11/1994 | Chavez et al. | 252/8.6 |
| 5,399,272 | 3/1995 | Swartley et al. | 252/8.8 |

FOREIGN PATENT DOCUMENTS

| | | |
|---|---|---|
| 0 239 910 | 10/1987 | European Pat. Off. . |
| 0 346 634 | 12/1989 | European Pat. Off. . |
| 38 18061 | 12/1989 | Germany . |
| D 06 M 13/46 | 12/1989 | Germany . |
| 384714 | 12/1932 | United Kingdom . |
| WO 93/16157 | 8/1993 | WIPO . |

OTHER PUBLICATIONS

Houben–Weyl, Methoden Der Organischen Chemie, Georg Thieme Verlag, Stuttgart vol. 11/1 p. 108ff.

Houben–Wehyl (1957)* no month available, *Methoden Der Organischen Chemie*, Georg Thieme Verlag, Stuttgart 1957, 11/1 pp. 108–117.

*Primary Examiner*—Paul Lieberman
*Assistant Examiner*—John R. Hardee
*Attorney, Agent, or Firm*—Scully, Scott, Murphy & Presser

[57] ABSTRACT

The disclosed invention relates to aqueous fabric softeners containing

A) 22–30% by weight of at least one compound of the general formula (1)

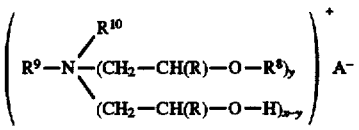

(1)

B) 0–7% by weight of one or more amides of the general formula (2)

$$[R^{11}—C(O)NH—(CH_2)_3—N(CH_3)_2R^{12}]^+ A^- \quad (2)$$

C) 0.5–6% by weight of one or more compounds of the general formula (3)

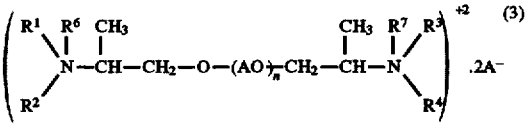

(3)

and electrolyte salts, perfume oils, short-chain alcohol and water.

6 Claims, No Drawings

HIGHLY CONCENTRATED AQUEOUS FABRIC SOFTNERS HAVING IMPROVED STORAGE STABILITY

This application is a continuation of application Ser. No. 08/391,789, filed Feb. 21, 1995, now abandoned.

The present invention relates to fabric softeners in the form of aqueous dispersions.

When washing textiles, so-called fabric softeners are used, as is known, in the last wash cycle. This reduces the hardening of the fabric caused by drying. This gives the textiles thus treated, such as towels and bath towels and underwear and bed linen, a more pleasant handle.

The fabric softeners used are usually cationic compounds, for example quaternary ammonium compounds, which, in addition to long-chain alkyl radicals, may also contain ester or amide groups, for example as described in U.S. Pat. Nos. 3,349,033, 3,644,203, 3,997,453, 4,073,735, and 4,119,545. These components are added to the rinsing bath on their own or in mixtures with other cationic or else neutral substances in the form of aqueous dispersions.

Frequently used compounds are ammonium compounds containing ester bonds, such as described, for example, in EP-A-0,239,910, U.S. Pat. No. 3,915,867, U.S. Pat. No. 4,137,180, and U.S. Pat. No. 4,830,771.

Particularly widely used compounds are ester compounds based on triethanolamine, such as N-methyl-N,N-bis(beta-$C_{14-18}$-acyloxyethyl)-N-beta-hydroxyethyl ammonium methosulfate, which are sold under tradenames such as TETRANYL® AT 75 (trademark of the Kao Corp.), STEPANTEX® VRH 90 (trademark of the Stepan Corp.) or REWOQUAT® WE 18 (trademark of REWO Chemische Werke GmbH).

Using batch processes known per se, these products make it possible to prepare fabric softeners without using auxiliaries, such as ethoxylated alcohols and amines (U.S. Pat. No. 4,844,823), fatty acids (DE-A-3,818,061), as stable dispersions (that is, showing an increase in viscosity of less than 100 mPas over a period of four weeks of storage) having a starting viscosity of less than 100 mPas up to a concentration of no more than 20% by weight. Today's requirements for so-called "ultra-concentrates" having concentrations of more than 20% by weight can thus not be met.

In the case of higher solid contents, diluting substances, such as, for example, alcohol ethoxylates or propoxylates or amine ethoxylates or propoxylates or mixtures (EP-A-0 346 634, U.S. Pat. No. 4,844,823) or else di(fatty acid) trialkanolamine ester salts (WO 93/16,157) have to be added. In all these examples containing the abovementioned viscosity regulators, that is, substances which maintain their dispersion prepared in the form of a thin liquid, a maximum solids content of up to 27–28% can be reached.

An object of the present invention then is to overcome these disadvantages of the prior art and to prepare highly concentrated aqueous dispersions containing fabric softeners.

The object has been achieved by the additional use of alkoxylated amines based on polypropylene oxide.

BRIEF SUMMARY OF THE INVENTION

Accordingly, the invention relates to aqueous fabric softeners containing

A) 22–30% by weight of at least one quaternary ammonium ester compound of the general formula (1)

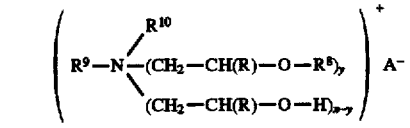

(1)

in which R is H or —$CH_3$, $R^8$ is H or —$CH_3$ and at least once a substituted or unsubstituted acyl radical having 6–22 carbon atoms, preferably 8–18 carbon atoms, which may contain multiple bonds, $R^9$ is —$CH_3$ or a radical —$CH_2$—CH(R)—OH, $R^{10}$ is H, —$CH_3$, —$C_2H_5$, or —$C_2H_4$—OH, y is 1 or 2, x is 2 and $A^-$ is an organic and/or inorganic anion; and B) 0–7% by weight of an amino amide of the general formula (2)

$$[R^{11}—C(O)NH—(CH_2)_3—N(CH_3)_2R^{12}]^+ A^- \quad (2)$$

in which $R^{11}$ is a substituted or unsubstituted hydrocarbon radical having 6–22 carbon atoms, preferably 8–18 carbon atoms, which may contain multiple bonds, $R^{12}$ is one of the radicals —$CH_3$, —$C_2H_5$, or —$C_2H_4$—OH, and $A^-$ is an organic or inorganic anion; and C) 0.5–6% by weight of a compound of the general formula (3)

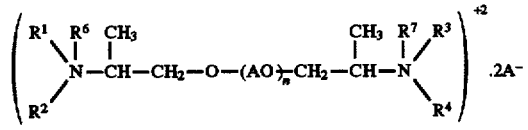

(3)

in which AO is the radical —CH($CH_3$)—$CH_2$—O— and/or the radical —$CH_2$—$CH_2$—O—; and in which $R^1$, $R^2$, $R^3$, $R^4$, are identical or different from one another, and are each the radical H—(O—CH(R)—$CH_2$—)$_m$—, in which R is H or a methyl or ethyl radical and m is 1–10, the sum of all m being preferably between 4 and 30, in particular 4 and 20; $R^6$ and $R^7$, are identical or different from one another, and are each H, —$CH_3$, —$C_2H_5$ or —$C_2H_4$OH; n is 1–30, preferably 1–15 and in particular 2–8, and $A^-$ is an organic and/or inorganic anion; and D) 0–1.5% by weight of an electrolyte salt and E) 0.5–1.5% by weight of a perfume oil and F) 2.0–7.0% by weight of a short-chain alcohol containing 1 to 8 carbon atoms and/or a compound of the general formula (4)

$$R^{13}O—(CH_2)_c—O—[—(CH_2)_d—O—]_eOR^{14} \quad (4)$$

in which $R^{13}$ and $R^{14}$, independently of one another, are each H, $CH_3$— or $C_2H_5$—; c and d are each 2–6; and e is 1–10; and G) water to add up to 100% by weight.

Further aspects of the invention are characterized by the claims.

DETAILED DESCRIPTION OF THE INVENTION

The quaternary compounds of the general formula (1) which are additionally used according to the invention are prepared by esterification of alkanolamines with fatty acid, followed by quaternization, using methods generally known in the art.

The fatty acids used for esterification or transesterification are the monobasic fatty acids based on natural vegetable and animal oils having 6–22 carbon atoms, in particular those having 8–18 carbon atoms, which are known and customary in the art, such as, in particular, coconut fatty acids, palm fatty acids, tallow fatty acids, or castor oil fatty acids, in the form of their glycerides, methyl esters or ethyl esters or as free acids.

The unsaturation, i.e. multiple bond, content of these fatty acids or fatty acid esters can, if necessary, be adjusted to iodine numbers between 30 and 50 by means of the known catalytic hydrogenation methods.

The iodine number, that is, the number which measures the average degree of saturation of a fatty acid, is the amount of iodine absorbed by 100 g of the compound for saturating the double bonds.

According to the invention, preference is given to tallow fatty acids and palm fatty acids having iodine numbers between 35 and 45. They are commercially available products and are offered by various companies under their respective tradenames.

Esterification or transesterification is carried out by known methods. This is effected by reacting the alkanolamine with the amount of fatty acid or fatty acid ester corresponding to the desired degree of esterification, if desired in the presence of a catalyst, methanesulfonic acid or hypophosphorous acid under nitrogen, at 160°–240° while continuously distilling off the water of reaction or the alcohol formed, during which, if desired, the pressure may be reduced in order to complete the reaction.

The subsequent quaternization is also carried out by known methods. According to the invention, the preferred procedure involves treating the ester, if desired with the additional use of a solvent, preferably of one of the general formula (4) together with, in particular, methoxypropanol, 1,2-propylene glycol and/or dipropylene glycol, at 60°–90° C. with equimolar amounts of the quaternizing agent with stirring, if desired under pressure, and monitoring the completion of the reaction by controlling the total amine number.

Preferably, the amount of solvent is selected in such a manner that it corresponds to the amount used in the end recipe.

Examples of additionally used quaternizing agents are short-chained dialkyl phosphates and dialkyl sulfates, such as, in particular, dimethyl sulfate, diethyl sulfate, dimethyl phosphate, diethyl phosphate, and short-chain halogenated hydrocarbons, in particular methyl chloride.

According to the invention, the additionally used compounds include those of the general formula (3)

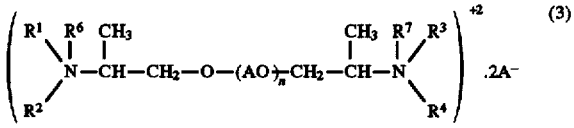

(3)

in which AO is the radical —CH(CH$_3$)—CH$_2$—O— and/or the radical —CH$_2$—CH$_2$—O— and in which R$^1$, R$^2$, R$^3$, R$^4$, which are identical or different from one another, are the radicals H—(O—CH(R)—CH$_2$—)$_m$—, in which R is H or a methyl or ethyl radical and m is 1–10, the sum of all m being preferably between 4 and 20, and R$^6$ and R$^7$, which are identical or different form one another, are each H, —CH$_3$, —C$_2$H$_5$, or —C$_2$H$_4$OH, and n is 1–30, preferably 1–15 and, in particular, 2–8, and A$^-$ is an organic and/or inorganic anion.

The starting compounds used for preparing the ammonium compounds additionally used according to the invention may include the following amine compounds of the formula (5):

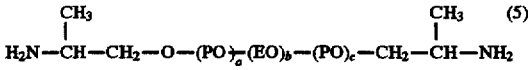

(5)

in which PO is —(O—CH$_2$—CH)— and EO is —(O—CH$_2$—CH$_2$)— and in which each of is a, b and c is 0–20 where (a+b+c) is n and n is 1–30, preferably 1–15 and, in particular, 2–8. According to the invention, preference is given to PO-based compounds where (a+c) is 1–15 and, in particular, 2–8.

These compounds are commercially available and are obtained by reacting polyoxyalkylene alcohols with ammonia under pressure using known methods.

The polyoxyalkylene alcohols are prepared by subjecting an alkylene oxide, essentially propylene oxide, ethylene oxide or a mixture of both, to an addition reaction with a compound containing one or more active hydrogen atoms using a customary method or by polymerization of alkylene oxides.

Useful compounds containing one or more active hydrogen atoms include monoalcohols, such as ethanol, isopropanol, butanol, lauryl alcohol, stearyl alcohol, but in particular methanol or glycols, such as ethylene glycol, propylene glycol, diethylene glycol, glycerol, trimethylolpropane, pentaerythritol, sorbitol, polyglycerol and polyvinyl alcohols.

The polyoxyalkylene alcohols have molecular weights in the range from about 100 to 10,000, preferably about 130–5,000 and particularly about 150–2,000.

Further reaction to give the amines takes place by aminolysis of the free hydroxyl groups or their esters, in particular their sulfuric esters, using methods known per se. In the case of higher alcohols, exchange of the OH group for the amino group takes place by homogeneous, but in particular heterogeneous, catalysis over solid catalysts. In particular two methods are available for this reaction. One uses dehydrating catalysts and the other hydrogenating/dehydrogenating catalysts.

An extensive bibliography is available on each of the following: the effect of temperature and pressure, ammonia excess, and the required residence times, (see Houben-Wehyl, Methoden der organischen Chemie (Methods of Organic Chemistry), Georg Thieme Verlag, Stuttgart 1957, Volume 11/1 p. 108ff and British Patent No. 384,714, U.S. Pat. No. 2,017,051, and U.S. Pat. No. 2,078,922).

According to the invention, preference is given to the following compounds of the formula (5):

$a+c=n=2–8$ $b=0$ or $a+c=n=2–3$ $b=6–9$

The compounds of the formula (5) are then alkoxylated, i.e., preferably ethoxylated or propoxylated, by methods known per se. In general, the procedure is such that the amines are reacted to completion in a pressurized reactor at 120°–160° C., if desired in the presence of basic, in particular alkaline, catalysts at 1–4 bar with an amount of alkylene oxide corresponding to the desired degree of alkoxylation, ethylene oxide and propylene oxide or mixtures thereof being preferred according to the invention.

This gives compounds of the general formula (6)

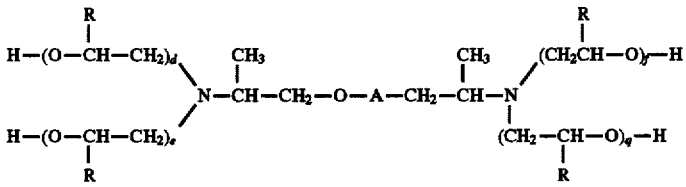

(6)

in which A is —$(PO)_a$—$(EO)_b$—$(PO)_c$ and in which a, b, c, EO and PO have the same meaning as listed above and d+e+f+g is m and m is 4–40 and the radicals R can be, independently of one another, —H, —$CH_3$ or —$C_2H_5$.

Preferred compounds of the formula (6) are compounds in which $$d+e+f+g=m=4\text{–}20 \quad \text{(III)}$$

and

R=H.

Quaternization or preparation of the salts of compounds (6) is carried out by the methods known in the art and leads to the amine quat or amine salts of the general formula (3) according to the invention, in which $R^6$ and $R^7$ have the meanings given.

In general, preparation of the salts takes place in such a manner that the acids, if desired as aqueous or alcoholic solutions, are added in portions to the initial charge of poly(oxyalkylene) alkanolamine compounds in an amount which corresponds to the desired degree of salt formation at 20°–80° C. with thorough stirring and optional cooling. Quaternization takes place by the generally known methods in which the poly(oxyalkylene) alkanolamines, if desired with the additional use of a solvent, are heated to 40°–80° C., and the quaternizing agent is added thereto in portions in an amount which corresponds to the desired degree of quaternization.

Accordingly, preferred anions $A^-$ include:

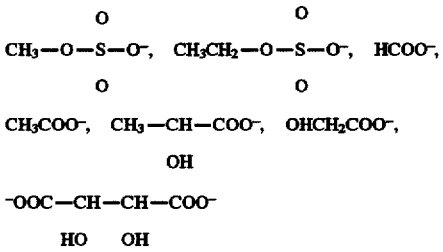

Apart from the components of the general formula (1), (2) and (3), the customary auxiliaries and additives can additionally be used for preparing the fabric softeners according to the invention. These include in particular dyes and scents, and electrolytes for viscosity control.

The combination according to the invention can be used to prepare highly concentrated fabric softeners which give the textile materials treated, in addition to a pleasant soft handle, improved backwetting power.

The fabric softeners are prepared by emulsifying or dispersing the particular individual components in water. This can be done by using the procedures customary in the art.

The procedure is usually such that the water preheated to about 10° C. below the clear melting point of the fabric softeners is introduced, and then first the dye solution and then the antifoam emulsion if required and finally the clear melt of the individual fabric softeners are introduced in succession and dispersed therein with thorough stirring. After addition of a portion of an electrolyte solution, perfume oil is metered in, followed by addition of the remaining amount of electrolyte solution, and the resulting mixture is then allowed to cool to room temperature with stirring. The fabric softeners according to the invention may contain the components mentioned within the limits given.

Like the fabric softeners belonging to the prior art, the fabric softeners according to the invention are added during the last rinse cycle, following the actual washing process. After dilution with water, the application concentration is, depending on the area of application, in the range from 0.1 to 10 g of fabric softener per liter of treatment liquid.

Preparation of the Dispersions

First, the water preheated to about 10° C. below the clear melting point of the fabric softeners was introduced, and then first the dye solution and then the antifoam emulsion if required and finally the clear melt of the individual fabric softeners were introduced in succession and dispersed therein thorough stirring. After addition of a portion of an electrolyte solution, perfume oil was metered in, followed by addition of the remaining amount of electrolyte solution, and the resulting mixture was then allowed to cool to room temperature with stirring. The fabric softeners according to the invention contained the components mentioned within the limits given.

Analytical Methods

The viscosity was measured with a commercially available Brookfield viscometer (model: LVT). Prior to the measurements, the dispersions were stored at 20° C. for at least six hours for the purpose of temperature control.

Dry solids were determined using a Mettler LP 16 drying apparatus. The sample to be measured was placed on a glass fiber mat (about 1.5 g) and dried at a constant temperature (105° or 130° C.) to constant weight. The dry solids were calculated from the particular initial and final weight.

In the following examples:

Component I was formula (3) where AO was propylene oxide, n was 5.6, $R^1$, $R^2$, $R^3$, $R^4$ were $H(O—CH_2—CH_2—)_m$—, in which the sum of all four m values was 4, $R^6$ and $R^7$ were —$CH_3$, and $A^-$ was $CH_3OSO_3$—.

Component II was formula (3) where AO was propylene oxide, n was 5.6, $R^1$, $R^2$, $R^3$, $R^4$ were $H(O—CH_2—CH_2—)_m$—, in which the sum of all four m values was 20, $R^6$ and $R^7$ were —$CH_3$, and $A^-$ was $CH_3OSO_3$—.

Component III was formula (3) where AO was propylene oxide, n was 5.6, $R^1$, $R^2$, $R^3$, $R^4$ were $H(O—CH_2—CH_2—)_m$—, in which the sum of all four m values was 10, $R^6$ and $R^7$ were —$CH_3$ and $A^-$ was $CH_3OSO_3$—.

Component A was a reaction product obtained from reacting a 2:1.25 mixture of HPaCT/TEA containing 15% by weight of DPG, quaternized with dimethyl sulfate (DMS).

TEA=triethanolamine

DPG=dipropylene glycol

HPaCT*: palm fatty acids having an acid number of 209, an iodine number of 37 and a carbon chain distribution of:

| No. of Carbons | No. of double bonds | wt. % |
|---|---|---|
| 14 | 0 | 1 |
| 16 | 0 | 47 |
| 16 | 1 | 0 |
| 17 | 0 | 0 |
| 18 | 0 | 14 |
| 18 | 1 | 36 |
| 18 | 2 | 1 |

HTiCT*: tallow fatty acids having an acid number of 205, an iodine number of 41 and a carbon-chain distribution of

| No. of Carbons | No. of double bonds | wt. % |
|---|---|---|
| 14 | 0 | 2 |
| 16 | 0 | 26 |
| 16 | 1 | 2 |
| 17 | 0 | 2 |
| 18 | 0 | 28 |
| 18 | 1 | 37 |
| 18 | 2 | 2 |

* commercial products from Henkel KGaA, Düsseldorf, Germany.

Component $A^1$ was the reaction product of 2:1.13 HPaCT/TEA, in 10% by weight of isopropanol, quaternized with DMS Component $A^2$ was the reaction product of 2:1.13 HTiCT/TEA, in 10% by weight of isopropanol, quaternized with DMS.

Component B was formula (2) in which $R^{11}$ was the radical or mixture of radicals HPaCT, $R^{12}$ was —$CH_3$, in 15% by weight of DPG.

EXAMPLES

Example 1

31.8 g of component A 1.00 g of dye (1% solution of SANDOLAN® Walkblau NBL from Sandoz)

0.25 g of antifoam (Antifoam DB 110 A from Dow)

2.80 g of component II 1.00 g of the perfume oil Fragrance® (D 60515 W from Haarmann and Reimer GmbH)

0.62 g of $CaCl_2$ (electrolyte)

water, 13° of German hardness, to add up to 100 g.

Dry solids: 31%.

The final viscosity of this dispersion was 120 mPas. Storage over a period of 4 weeks raised the viscosity to about 500 mPas.

Example 2

30.1 g of component A 1.00 g of dye (1% solution of SANDOLAN® Walkblau BBL 150 from Sandoz)

0.25 g of antifoam (Antifoam DB 110 A from Dow)

1.60 g of component B 2.0 g of component II 1.00 g of the perfume oil Fragrance® (D 60515 W from Haarmann and Reimer GmbH)

0.73 g of $CaCl_2$ water, 13° if German hardness, to add up to 100 g.

Dry solids: 30.5%.

The final viscosity was 120 mPas; after 4 weeks, the viscosity had risen to about 700 mPas.

Example 3

30.1 g of component A 1.00 g of dye (1% solution of SANDOLAN® Walkblau NBL 150 from Sandoz)

0.25 g of antifoam (Antifoam DB 110 A from Dow)

1.60 g of component B 1.00 g of component I 1.00 g of the perfume oil Fragrance® (D 60515 W from Haarmann and Reimer GmbH)

0.85 g of $CaCl_2$ water, 13° if German hardness, to add up to 100 g.

Dry solids: 30.1%.

The final viscosity was 110 mPas; after 4 weeks, the viscosity had risen to about 250 mPas.

Example 4

30.1 g of component A 1.00 g of dye (1% solution of SANDOLAN® Walklau NBL 150 from Sandoz)

0.25 g of antifoam (Antifoam DB 110 A from Dow)

1.60 g of component B 2.00 g of component III 1.00 g of the perfume oil Fragrance® (D 60515 W from Haarmann and Reimer GmbH)

0.73 g of $CaCl_2$ water, 13° of German hardness, to add up to 100 g.

Dry solids: 30.7%.

The final viscosity was 130 mPas; after 4 weeks, the viscosity had risen to about 500 mPas.

Example 5

30.1 g of component A 1.00 g of dye (1% solution of SANDOLAN® Walkblau NBL 150 from Sandoz)

0.25 g of antifoam (Antifoam DB 110 A from Dow)

1.60 g of component B 2.00 g of component I 1.00 g of the perfume oil Fragrance® (D 60515 W from Haarmann and Reimer GmbH)

0.79 g of $CaCl_2$ water, 13° of German hardness, to add up to 100 g.

Dry solids: 30.3%.

The final viscosity was 100 mPas; after 4 weeks, the viscosity had risen to about 250 mPas.

Example 6

30.1 g of component A 1.00 g of dye (1% solution of SANDOLAN® Walkblau NBL 150 from Sandoz)

0.25 g of antifoam (Antifoam DB 110 A from Dow)

1.60 g of component B 1.00 g of component I 1.00 g of perfume oil Fragrance® (D 60515 W from Haarmann and Reimer GmbH)

0.85 g of $CaCl_2$ water, 13° of German hardness, to add up to 100 g.

Dry solids: 30.1%.

The final viscosity was 110 mPas; after 4 weeks, the viscosity had risen to about 250 mPas.

Example 7

30.1 g of component A 1.00 g of dye (1% solution of SANDOLAN® Walkblau NBL 150 from Sandoz)

0.25 g of antifoam (Antifoam DB 110 A from Dow)

1.60 g of component B 3.00 g of Component I 1.00 g of the perfume oil Fragrance® (D 60515 W from Haarmann and Reimer GmbH)

0.93 g of $CaCl_2$ water, 13° of German hardness, to add up to 100 g.

Dry solids: 31.3%.

The final viscosity was 130 mPas; after 4 weeks, the viscosity had risen to about 500 mPas.

Example 8

30.6 g of component A 1.00 g of dye (1% solution of SANDOLAN® Walkblau NBL 150 from Sandoz)

0.25 g of antifoam (Antifoam DB 110 A from Dow)

3.00 g of Component I 1.00 g of the perfume oil Fragrance® (D 60515 W from Haarmann and Reimer GmbH)

0.70 g of $CaCl_2$ water, 13° of German hardness, to add up to 100 g.

Dry solids: 29.2%.

The final viscosity was 120 mPas; after 4 weeks, the viscosity had risen to about 140 mPas.

Example 9

31.8 g of component A 1.00 g of dye (1% solution of SANDOLAN® Walkblau NBL 150 from Sandoz)

0.25 g of antifoam (Antifoam DB 110 A from Dow)

2.00 g of Component I 1.00 g of the perfume oil Fragrance® (D 60515 W from Haarmann and Reimer GmbH)

0.87 g of $CaCl_2$ water, 13° of German hardness, to add up to 100 g.

Dry solids: 31.0%.

The final viscosity was 140 mPas; after 4 weeks, the viscosity had risen to about 250 mPas.

Example 10

29.7 g of component A 1.00 g of dye (1% solution of SANDOLAN® Walkblau NBL 150 from Sandoz)

0.25 g of antifoam (Antifoam DB 110 A from Dow)

5.90 g of Component III 1.00 g of the perfume oil Fragrance® (D 60515 W from Haarmann and Reimer GmbH)

water, 13° of German hardness, to add up to 100 g.

Dry solids: 31.1%.

The final viscosity was 90 mPas; after 4 weeks, the viscosity had risen to about 100 mPas.

Example 11

28.2 g of component A 1.00 g of dye (1% solution of SANDOLAN® Walkblau NBL 150 from Sandoz)

0.25 g of antifoam (Antifoam DB 110 A from Dow)

9.50 g of Component I 1.00 g of the perfume oil Fragrance® (D 60515 W from Haarmann and Reimer GmbH)

water, 13° of German hardness, to add up to 100 g.

Dry solids: 33.5%.

The final viscosity was 75 mPas; after 4 weeks, the viscosity had risen to about 250 mPas.

Example 12

28.6 g of component A 1.00 g of dye (1% solution of SANDOLAN® Walkblau NBL 150 from Sandoz)

0.25 g of antifoam (Antifoam DB 110 A from Dow)

6.80 g of Component II 1.00 g of the perfume oil Fragrance® (D 60515 W from Haarmann and Reimer GmbH)

water, 13° of German hardness, to add up to 100 g.

Dry solids: 31.1%.

The final viscosity was 80 mPas; after 4 weeks, the viscosity had risen to about 100 mPas.

Example 13

26.7 g of component A 1.60 g of component B 1.00 g of dye (1% solution of SANDOLAN® Walkblau NBL 150 from Sandoz)

0.25 g of antifoam (Antifoam DB 110 A from Dow)

7.30 g of Component II 1.00 g of the perfume oil Fragrance® (D 60515 W from Haarmann and Reimer GmbH)

water, 13° of German hardness, to add up to 100 g.

Dry solids: 32.4%.

The final viscosity was 90 mPas; after 4 weeks, the viscosity had risen to about 150 mPas.

COMPARATIVE EXAMPLES

Example 14

24.4 g of component $A^1$ 1.00 g of dye (1% solution of SANDOLAN® Walkblau NBL 150 from Sandoz)

0.25 g of antifoam (Antifoam DB 110 A from Dow)

1.00 g of the perfume oil Fragrance® (D 60515 W from Haarmann and Reimer GmbH)

0.6 g of $CaCl_2$ water, 13° of German hardness, to add up to 100 g.

Dry solids: about 22%.

Final viscosity: 80 mPas; after four weeks of storage at room temperature, the viscosity had risen to more than 300 mPas.

Example 15

24.5 g of component $A^2$ 1.00 g of dye (1% solution of SANDOLAN® Walkblau NBL 150 from Sandoz)

0.25 g of antifoam (Antifoam DB 110 A from Dow)

b 1.00g of the perfume oil Fragrance® (D 60515 W from Haarmann and Reimer GmbH)

0.90 g of $CaCl_2$ water, 13° of German hardness, to add up to 100 g.

Dry solids: about 22.5%.

Final viscosity: 110 mPas; the viscosity could not be brought below 100 mPas using an electrolyte salt; after just two weeks of storage at room temperature, the viscosity had risen to more than 300 mPas.

What is claimed is:

1. An aqueous fabric softener comprising

A) 22–30% by weight of one or more compounds of the general formula (1)

$$\left(R^9-N^{R^{10}}_{(CH_2-CH(R)-O-H)_{x-y}}^{(CH_2-CH(R)-O-R^8)_y}\right)^+ A^- \quad (1)$$

in which R is —H or —$CH_3$, $R^8$ is H or —$CH_3$ and at least one $R^8$ group is an acyl radical having 6–22 carbon atoms, which optionally contains multiple bonds, wherein the acyl radical is unsubstituted or substituted with —OH; $R^9$ is —$CH_3$ or a radical of the formula —$CH^2$—CH(R)—OH; $R^{10}$ is H, —$CH_3$, —$C_2H_5$, or —$C_2H_4$—OH; y is 1 or 2 and x is 2; and $A^-$ is an organic or inorganic anion; and B) 0–7% by weight of an amino amide of the general formula (2)

$$(R^{11}-C(O)NH-(CH_2)_3-N(CH_3)_2R^{12})^+ A^- \quad (2)$$

in which $R^{11}$ is a hydrocarbon radical having 6–22 carbon atoms, which optionally contains multiple bonds, wherein the hydrocarbon radical is unsubstituted or substituted with —OH; $R^{12}$ is one of the radicals —$CH_3$, —$C_2H_5$, or —$C_2H_4$—OH; and $A^-$ is an organic or inorganic anion; and C) 0.5–3% by weight of a compound of the formula (3)

$$\left(R^1\,R^6\,CH_3\,N-CH-CH_2-O-(AO)_n-CH_2-CH-N\,CH_3\,R^7\,R^3\,R^2\,R^4\right)^{+2} .2A^- \quad (3)$$

in which AO in each occurrence is the radical —$CH(CH_3)$—$CH_2$—O— or the radical —$CH_2$—$CH_2$—O—; $R_1$, $R^2$, $R^3$ and $R^4$ are identical or different from one another and each is a radical of the formula H—(O—CH(R)—$CH_2$—)$_m$—, in which R is H or a methyl or ethyl radical and each m is 1–10; $R^6$ and $R^7$ are identical or different from one another and each is H, —$CH_3$, —$C_2H_5$, or —$C_2H_4OH$; n is 1–30; and $A^-$ is an organic or inorganic anion; and D) 0–1.5% by weight of an electrolyte salt; and E) 0.5–1.5% by weight of a perfume oil; and F) 2.0–7.0% by weight of one or more compounds selected from the group consisting of short-chain alcohols containing 1 to 8 carbon atoms and compounds of the general formula (4)

$$R^{13}O-(CH_2)_c-O-(-(CH_2)_d-O-)_eOR^{14} \quad (4)$$

in which $R^{13}$ and $R^{14}$ independently of one another are H, $CH_3$— or $C_2H_5$—; c and d are each 2–6; and e is 1–10; and G) water to add up to 100% by weight.

2. An aqueous fabric softener according to claim 1, comprising 24–29% by weight of one or more compounds of the general formula (1), in which $R^8$ is a substituted or unsubstituted acyl radical having 8–18 carbon atoms and an iodine number of 20–50, which optionally contains multiple bonds.

3. An aqueous fabric softener according to claim 1, comprising 24–29% by weight of one or more compounds of the general formula (1), in which $R^8$ is the radical of palm fatty acid having an iodine number of 30–40.

4. An aqueous fabric softener according to claim 1, characterized in that component C) consists of one or more compounds of the general formula (3) in which the sum of all m values is 4 to 30.

5. An aqueous fabric softener according to claim 1, characterized in that component C) consists of one or more compounds of the general formula (3) in which AO is the radical —$CH(CH_3)$—$CH_2$—O— and n is from 1 to 15.

6. An aqueous fabric softener according to claim 1, characterized in that component C) consists of one or more compounds of the general formula (3) in which $R^6$ and $R^7$ are —$CH_3$ and $A^-$ is $CH_3OSO_3$—.

* * * * *

UNITED STATES PATENT AND TRADEMARK OFFICE

CERTIFICATE OF CORRECTION

PATENT NO. : 5,703,035

DATED : December 30, 1997

INVENTOR(S) : Horst Birkhan, et al.

It is certified that error appears in the above-indentified patent and that said Letters Patent is hereby corrected as shown below:

Column 10, line 54: delete "b".

Signed and Sealed this

Thirtieth Day of November, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,703,035

DATED : December 30, 1997

INVENTOR(S) : Horst Birkhan, et al.

It is certified that error appears in the above-identified patent and that said Letters Patent is hereby corrected as shown below:

On the Title Page, Section [56], line 3: "Ransom et al." should read --Arnold et al. -- and line 15: "5,108,508" should read --5,180,508--

On the Title Page, under "OTHER PUBLICATIONS", lines 1-2: delete "Houben-Weyl, Methoden Der Organischen Chemie, Georg Thieme Verlag, Stuttgart vol. 11/1 p. 108ff."

Column 5, lines 41-50:

"

$$CH_3-O-\overset{\overset{\displaystyle O}{\|}}{\underset{\underset{\displaystyle O}{\|}}{S}}-O^-,\quad CH_3CH_2-O-\overset{\overset{\displaystyle O}{\|}}{\underset{\underset{\displaystyle O}{\|}}{S}}-O^-,\quad HCOO^-,$$

$$CH_3COO^-,\quad CH_3-\underset{\underset{\displaystyle OH}{|}}{CH}-COO^-,\quad OHCH_2COO^-,$$

$$^-OOC-\underset{\underset{\displaystyle HO}{|}}{CH}-\underset{\underset{\displaystyle OH}{|}}{CH}-COO^-$$

"

should read

--

$$CH_3-O-\overset{\overset{\displaystyle O}{\|}}{\underset{\underset{\displaystyle O}{\|}}{S}}-O^-\ ,\quad CH_3CH_2-O-\overset{\overset{\displaystyle O}{\|}}{\underset{\underset{\displaystyle O}{\|}}{S}}-O^-\ ,\quad HCOO^-\ ,\quad CH_3COO^-$$

$$CH_3-\underset{\underset{\displaystyle OH}{|}}{CH}-COO^-\ ,\quad OHCH_2COO^-\ ,\quad ^-OOC-\underset{\underset{\displaystyle HO}{|}}{CH}-\underset{\underset{\displaystyle OH}{|}}{CH}-COO^-$$

--

UNITED STATES PATENT AND TRADEMARK OFFICE

CERTIFICATE OF CORRECTION

PATENT NO. : 5,703,035

DATED : December 30, 1997

INVENTOR(S) : Horst Birkhan, et al.

It is certified that error appears in the above-identified patent and that said Letters Patent is hereby corrected as shown below:

Column 6, lines 53, 58 & 63: " $CH_3OSO_3$ — – " should read – $CH_3OSO_3$ — –

Column 10, line 54: delete " b "

Signed and Sealed this

Eighteenth Day of April, 2000

*Attest:*

*Attesting Officer*

Q. TODD DICKINSON

*Director of Patents and Trademarks*